US005524980A

United States Patent [19]

Carter et al.

[11] Patent Number: 5,524,980

[45] Date of Patent: Jun. 11, 1996

[54] MEDICINE CABINET ORGANIZING INSERT

[75] Inventors: Terry A. Carter; Janet L. Carter, both of Tarzana; Steven V. Mishkin; Carlyn H. Mishkin, both of Los Angeles, all of Calif.

[73] Assignee: RX For Organization, Canoga Park, Calif.

[21] Appl. No.: 92,261

[22] Filed: Jul. 15, 1993

[51] Int. Cl.[6] ..... A47B 81/00; A47B 96/02

[52] U.S. Cl. ..... 312/351; 211/88; 312/245

[58] Field of Search ..... 211/88, 70.6, 187; 312/242, 245, 348.3, 351

[56] References Cited

U.S. PATENT DOCUMENTS

| | | | |
|---|---|---|---|
| 3,306,689 | 2/1967 | Isaacson et al. | 312/351 |
| 3,515,450 | 6/1970 | Jaecke | 312/245 |
| 3,521,936 | 7/1970 | Coker | 312/245 |
| 4,134,625 | 1/1979 | Palka | 312/245 |
| 4,776,650 | 10/1988 | Ferenzi | 312/245 |
| 5,139,327 | 8/1992 | Aisley | 312/351 |

*Primary Examiner*—Richard A. Bertsch
*Assistant Examiner*—William Wicker
*Attorney, Agent, or Firm*—David O'Reilly

[57] ABSTRACT

A medicine cabinet organizing insert comprised of a rectangular frame having a side wall, top wall and bottom walls with one side of the frame being open. A vertical divider in the rectangular frame divides the organizing insert into two vertical compartments. One compartment divided into approximately 60% of the organizer has a plurality of adjustable shelves. Two of the shelves have specially designed slots for storing particular toilet articles. The open side of the rectangular frame has scored areas to remove a portion of the frame for fitting narrower designed existing medicine cabinets. The medicine cabinet organizer is easily installed in existing medicine cabinets to replace existing shelves. With the shelves removed, the organizer may be simply placed in the opened cavity of existing medicine cabinets and secured with double faced adhesive tape or installed with mounting screws.

32 Claims, 4 Drawing Sheets

MEDICINE CABINET ORGANIZING INSERT

FIELD OF THE INVENTION

This invention relates to organizers for medicine and utility cabinets and more particularly relates to an organizing insert for installation in existing medicine cabinets.

BACKGROUND OF THE INVENTION

A variety of medicine cabinets have been designed in attempts to maximize the utility of the cabinets. However, many cabinets still exist that have insufficient or inconvenient storage space. Many of the present cabinets even being sold today have only three shelves for storing toilet articles.

In most cases, these shelves are made out of glass or plastic and have only marginal utility. They also may be adjustable to accommodate large articles. However often the adjustment of the shelves reduces the utilitarian aspects of the medicine cabinet. Adjusting for example the center shelf down, will usually leave a shelf that will only accommodate very small articles. If not many such articles are available, then considerable space is wasted.

In order to increase the utility of medicine cabinets various designs for medicine cabinets and utility cabinets have been proposed. Once such newly designed cabinet is shown in Aisley U.S. Pat. No. 5,139,322. This cabinet is constructed predominately of molded plastic components. The medicine cabinet is a preformed housing having an open front side. Upright central brackets support a plurality of adjustable half width and full width shelves. While this cabinet does propose some improvements that would be helpful, it requires completely replacing existing medicine cabinets.

Hearst U.S. Pat. No. 2,450,337 issued Sep. 28, 1948 discloses an auxiliary utility cabinet for installation in existing medicine cabinets. The small auxiliary cabinet is installed in the wall of the cabinet and clamped in position on one side of a shelf of the cabinet. This auxiliary utility cabinet is a rather small cabinet that provides drawers for storage of small articles such as pills and other small articles.

Another patent that discloses an auxiliary cabinet is Gehrs U.S. Pat. No. 3,008,785, issued Nov. 14, 1961. This patent provides an auxiliary safety medicine cabinet for installation in an existing medicine cabinet. The cabinet is provided with a lock that is sufficiently complicated to prevent a child from accessing toxic medicines. This medicine cabinet is constructed to replace only one of the shelves in existing medicine cabinets.

Other cabinets which disclose various devices for improving storage space in medicine cabinets and the like are shown in Nairn U.S. Pat. No. 3,140,134 issued Jul. 7, 1964; Goldfarb U.S. Pat. No. 3,298,764 issued Jan. 17, 1967; Coker, Jr. U.S. Pat. No. 3,521,936 issued Jul. 28, 1970; and Britt et al U.S. Pat. No. 4,319,792 issued Mar. 16, 1982. Each of these devices show various structures that attempt to improve the storage space in medicine cabinets. They either have special shelves that install in the cabinet or small compartments that attempt to provide storage space for small articles. It would be advantageous if some device could be provided to completely replace all the shelves of a medicine cabinet that could provide substantial versatility in the storage of articles in the cabinet.

It is therefore, one object of the present invention to provide a medicine cabinet organizing insert that fits into standard size medicine cabinets and creates a more efficient use of the space available.

Yet another object of the present invention is to provide a medicine cabinet organizing insert that provides more usable storage in existing medicine cabinets and yet is inexpensive to produce.

Yet another object of the present invention is to provide a medicine cabinet organizing insert that utilizes storage space in a medicine cabinet that is simple and easy to install.

Still another object of the present invention is to provide a medicine cabinet organizing insert that is adjustable to fit various size medicine cabinets.

Still another object of the present invention is to provide a medicine cabinet organizing insert that is constructed of a material that is easy to clean.

Still another object of the present invention is to provide a medicine cabinet organizing insert that divides the cabinet into unequal storage spaces with one side having a plurality of adjustable shelves.

Still another object of the present invention is to provide a medicine cabinet organizing insert having a rectangular frame with at least one side wall, an upper and lower shelf, and a vertical divider integrally formed.

Yet another object of the present invention is to provide a medicine cabinet organizing insert that has a height which allows the top of the organizing insert to be used as an upper shelf.

Yet another object of the present invention is to provide a medicine cabinet organizing insert that includes at least two specially designed adjustable shelves to accommodate special toilet articles, such as toothpaste, toothbrushes, razors and the like.

Yet another object of the present invention is to provide a medicine cabinet organizing insert that has an open side designed to fit most standard medicine cabinets with at least three fixed shelves.

BRIEF DESCRIPTION OF THE INVENTION

The purpose of the present invention is to provide a nearly full size medicine cabinet organizing insert that substantially increases the utility of the storage space in existing medicine cabinets.

The medicine cabinet organizing insert of the present invention is comprised of a polystyrene plastic frame having at least one side wall, a top shelf, a bottom shelf, and a fixed vertical divider. In the preferred embodiment, the side wall vertical divider, top and bottom shelves are integrally formed with a back wall. The vertical space between the vertical divider and the side wall is divided into sections by a plurality of horizontal slots. These slots are provided for receiving a plurality of adjustable shelves to vary the vertical space in this section. The side wall and vertical center divider also have notches for supporting the adjustable shelves. The notches are designed to properly orient and support the adjustable shelves in the organizer.

Each of the adjustable shelves is provided with a tongue on a back edge for engaging a selected horizontal slot. Tabs on the opposite ends at a rear edge of each portable shelf include a shape that snap into the notches to securely retain the adjustable shelves in the vertical section of the medicine cabinet organizer. The tongue along the back edge has a ridge that fits into a groove in the slots of the back wall to frictionally retain the adjustable shelves. The shelves are easily removed by pulling them away from the cabinet allowing them to be reinstalled at a different section to vary the height of any one space.

The medicine cabinet organizer is preferably open along one side to allow adjustment for fitting existing medicine cabinets that are narrower in dimension. The open side has scored surfaces along a left edge to allow a section of material to be removed or snapped off to fit cabinets that are narrower in design. This open section to the left of the fixed vertical divider preferably has two fixed shelves in addition to the top shelf. In a preferred embodiment these shelves also have scored surfaces so the ends of the shelves can be removed to accommodate more narrowly dimensioned medicine cabinets.

A lower corner of the open side of the medicine cabinet organizer is constructed to fit the radius of a medicine cabinet for ease of installation. Likewise the lower right corner and the lower shelf are also contoured to fit the radius of a medicine cabinet. An optional, but preferred feature, is the inclusion of ridges or ribs on the lower shelf to accommodate small articles to prevent them from rolling out of the cabinet.

The rectangular frame constructed of the integrally formed side wall, fixed vertical divider, back wall, top shelf, bottom shelf and open left side of the medicine cabinet organizer preferably has a selected height that allows the organizer to be used in most existing medicine cabinets. Optionally, but preferably, the height is selected so that the top of the medicine cabinet organizer can serve as the upper shelf in the medicine cabinet. This reduces the possibility of any wasted space at the top of the medicine cabinet by trying to achieve a close fit.

The medicine cabinet is preferably supplied with fastening devices for quickly and easily fastening the insert to existing medicine cabinets. In the preferred embodiment double faced adhesive tape is provided for application to rear surface areas or indentations on the back of the medicine cabinet organizer. This double faced adhesive tape is covered with release paper that allows it to be easily applied to selected areas or recesses provided. This provides the user wide latitude in installation of the cabinet. The tape can be applied easily, either vertically or horizontally. To install the cabinet, pieces of double surface adhesive tape are applied to the rear of the back wall of the medicine cabinet organizer and the cabinet is simply fitted into the existing medicine cabinet with the back wall pressed tightly against the rear wall of the housing of the medicine cabinet. Several pieces of double faced adhesive tape are sufficient to securely hold the medicine cabinet organizer in the medicine cabinet. Optionally, screw holes are provided in the medicine cabinet organizing insert for a more fixed installation with screws into the back wall of the housing of an existing medicine cabinet.

A height of about 20" for the medicine cabinet organizing insert is selected so that it will be shorter than most standard medicine cabinets. This allows the top of the medicine cabinet organizing insert to be used as a shelf. If it were designed to fit perfectly in one cabinet, it might not fit in another and could create some wasted space at the top. By designing it so that it will be a few inches shorter than most medicine cabinets it automatically provides a shelf space at the top.

The lower left corner and right corners are designed to fit the radius of the existing medicine cabinets. The lower left corner is on the open side and is raised slightly to easily accommodate most standard medicine cabinets.

The lower shelf on the right side section between the side wall and the center divider is provided with ridges to provide a gripping surface for small articles. The corners again of the shelf and frame are contoured to fit the radius of the medicine cabinet.

As an option, the medicine cabinet organizer could be made to be one half or two thirds the size of an existing medicine cabinet to allow use of some of the existing shelves. In this embodiment, the medicine cabinet organizer insert would be provided with two side walls, an upper and lower shelves, and a plurality of adjustable shelves. This design can be used in standard medicine cabinets and allow one or two of the existing shelves to remain.

The above and other features of this invention will be fully understood from the following detailed description and the accompanying drawings, in which:

DETAILED DESCRIPTION OF THE INVENTION

Figure 1:
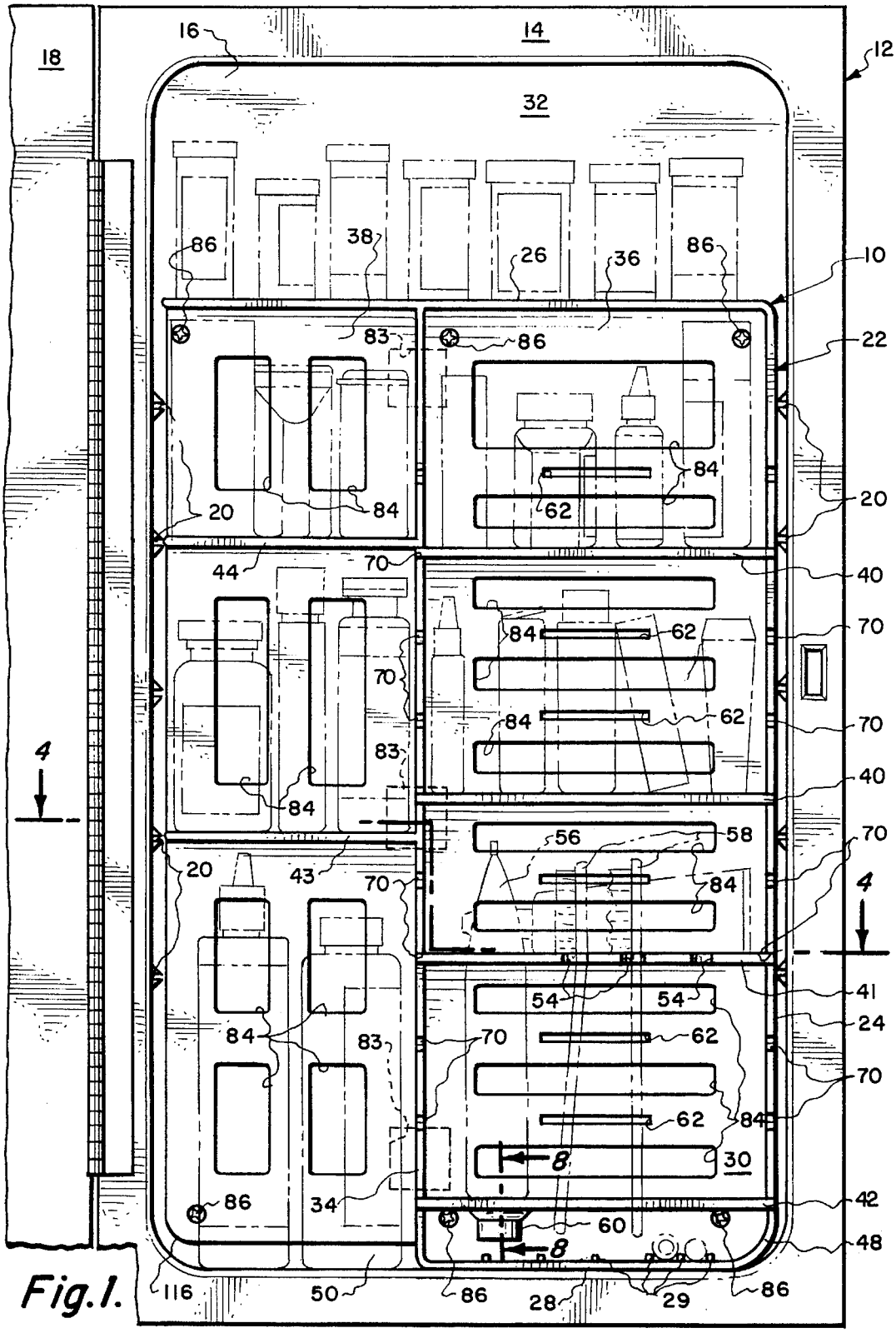
FIG. 1 is a plain view of a medicine cabinet organizer installed in an existing medicine cabinet.

A medicine cabinet organizing insert 10 is shown installed in an existing narrower medicine cabinet 12 comprised of a rectangular housing 14 and a rectangular cavity 16 and having the usual hinged mounted door 18. Slots 20 in rectangular housing 14 are provided for adjustable shelves used in existing medicine cabinet. To install medicine cabinet organizing insert 10, the shelves are removed from slots 20 leaving rectangular opening 16 completely clear.

Medicine cabinet organizing insert 10 is a substantially rectangular frame 22 having a side wall 24, top and bottom walls 26 and 28 respectively with one side of the rectangular frame being opened for purposes which will be described hereinafter. Medicine cabinet organizing insert 10 has a back 30 to provide support for adjustable shelves and for attachment of the organizer to the rear wall 32 of existing medicine cabinet 12.

Vertical divider 34 divides rectangular frame 22 into two vertical sections 36 and 38. Preferably vertical divider 34 separates rectangular frame 22 into vertical compartments 36 and 38 with approximately 60% for vertical compartment 36 and 40% for vertical compartment 38. Vertical compartment 36 is separated into storage spaces by a plurality of adjustable shelves 40, 41, and 42 which will be described in greater detail hereinafter. Vertical compartment 38 has a pair of fixed shelves 43 and 44 with top 26 providing a fixed shelf at the top. A preferred unique aspect of rectangular frame 22 is that the height is selected so that a space will be provided at the top of medicine cabinet 12. This minimizes wasted space that might occur by trying to provide a rectangular frame that perfectly fit the open space 16 in medicine cabinet 12. With a preselected height for frame 22, top 26 can be used as a fixed shelf.

Bottom wall 28 of rectangular frame 22 provides a bottom shelf. Lower right corner 48 of frame 22 is contoured to fit the radius of most medicine cabinets 12. A small space 50 is provided beneath the left vertical compartment 38 to be sure that cabinet organizing insert 10 fits comfortably in existing medicine cabinets 12 having a variety of designs. Adjustable shelves 41 and 42 are specially designed for storing toothpaste, toothbrushes, razors and the like as will be described in greater detail hereinafter.

Figure 2:
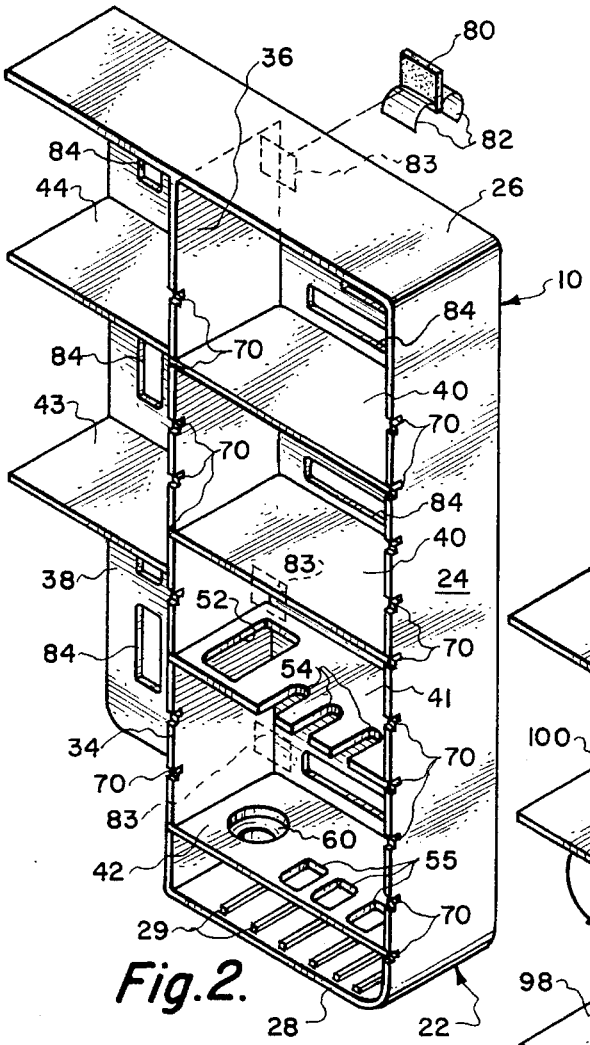
FIG. 2 is a perspective view of the medicine cabinet organizer of FIG. 1 completely assembled.
Figure 3:
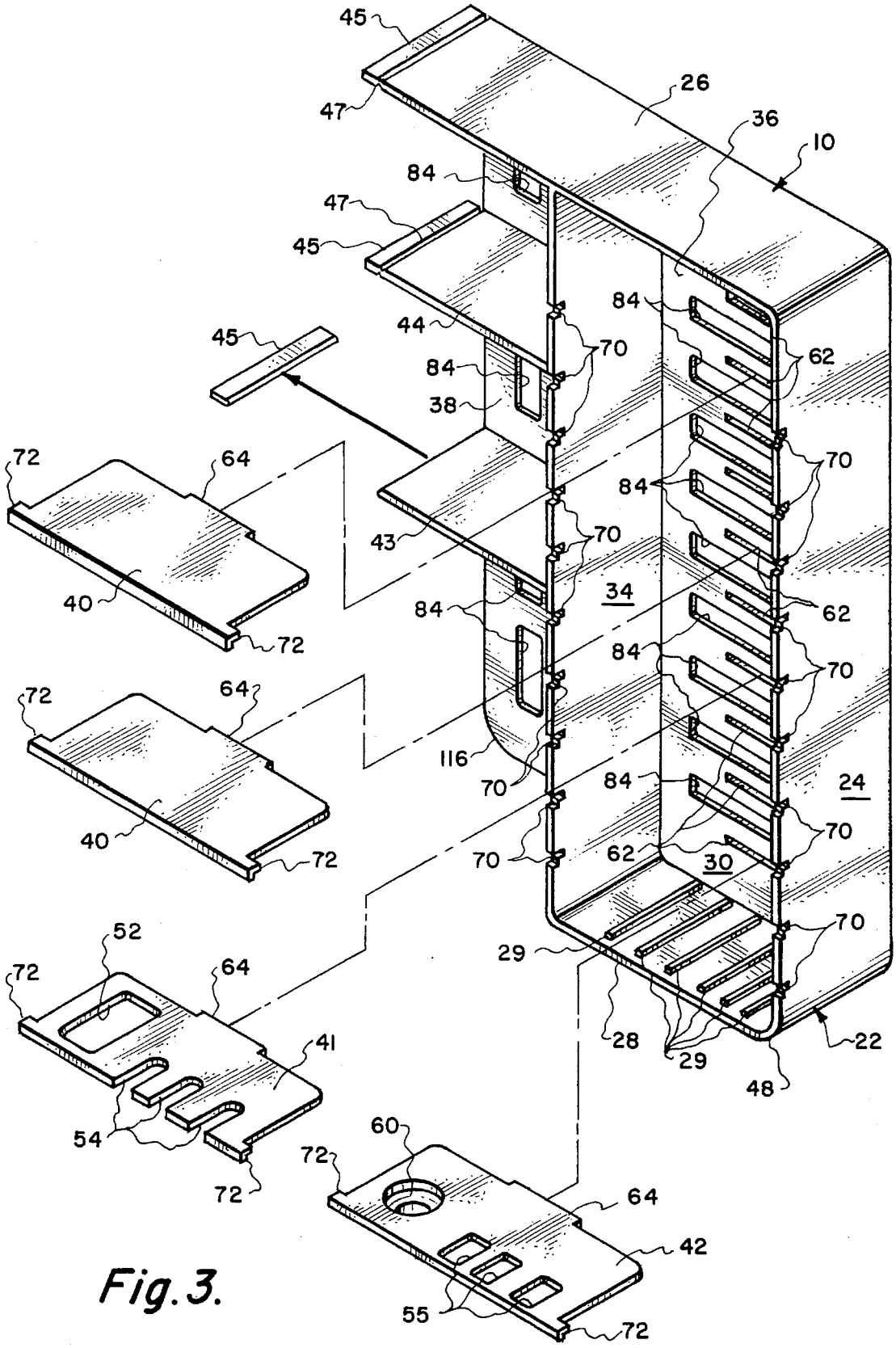
FIG. 3 is an exploded view of an organizer for wider medicine cabinets and illustrating the installation of the adjustable shelves.

The construction of medicine cabinet organizing insert 10 is shown in an assembled view of FIG. 2 and in an exploded view of FIG. 3. Rectangular frame is preferably constructed of a durable plastic such as a polystyrene, which may be easily cleaned. Frame 22 has side wall 24, top and bottom walls 26 and 28 back wall 30 and vertical divider 34. Vertical divider 34 separates rectangular frame into two vertical compartments 36 and 38 in an approximately 60%/40% ratio. Vertical compartment 36 has a plurality of adjustable shelves 40, 41, and 42 while vertical compartment 38 has fixed shelves 43 and 44. Bottom wall 28 and top wall 26 provide shelves as described previously. Preferably bottom wall 28 will have a series of ridges or ribs 29 to provide a non-slip surface for small articles.

Adjustable shelves 40, 41 and 42 are mounted in vertical compartment 36 by fitting tongue 64 in horizontal slot 62 provided in the back wall 30 of frame 22. Support for the rear edge of each adjustable shelf 40, 41 and 42 is provided by L-shaped tabs 72 fitting L-shaped notch 70 in side wall 24 and vertical divider 34. Slot 62 allow adjustable shelves 40, 41 and 42 to be in any one of ten positions to vary the spaces in vertical compartment 36.

Existing medicine cabinets 12 vary in height but may also vary in width. However generally the variation in width is only a small amount. To accommodate narrower medicine cabinets 12, fixed shelves 43 and 44 and top wall 26 of frame 22 on the open side extend slightly beyond the end of back wall 30 on the open side of frame 22 as shown in FIG. 3. The surface of fixed shelves 43, 44 and top wall 26 are weakened by a notch 47. This allows extensions 45 to be easily removed by bending to break at notch 47. Removal of extension 45 on fixed shelf 43 is illustrated by the arrow. This permits medicine cabinet organizer 10 to fit medicine cabinets 12 that have a narrower interior design.

The medicine cabinet organizer 10 is shown completely assembled in FIG. 2 with adjustable shelves 40, 41 and 42 installed and extensions 45 removed for installation in a narrower existing medicine cabinet such as that shown in FIG. 12 such as that shown in FIG. 1. Medicine cabinet organizer 10 can be installed with double faced adhesive tape 80 having removable release paper 82. Lengths of double face adhesive tape 80 provided are applied to flat surfaces on the rear of back wall 30. Preferably, adhesive tape 80 is in the form of squares that fit recesses or indentations 83 provided in the rear of organizing insert 10 so that it fits flat against the rear wall of the medicine cabinet 12. Three indentations 83 are provided for adhesive squares 80, but more could be used if desired. Double faced adhesive tape strips or squares 80 can be applied vertically or horizontally wherever there is a flat surface or an indentation 83 as shown in FIG. 1. Release paper 82 is then peeled from the other side of the double faced adhesive tape to install the organizing insert 10 in medicine cabinet 12.

After removing release paper 82 medicine cabinet organizing insert 10 is then positioned with bottom wall 28 resting on the bottom of cavity 16 in medicine cabinet 12 and pushed back until back wall 30 is flushed with the rear wall 32 of medicine cabinet 12. Application of pressure will cause double faced adhesive tape 80 to adhere firmly to the back wall 32 of medicine cabinet 12. Cut out areas 84 in back wall 30 of organizer 10 are for the purposes of reducing material costs and improving material flow for mold manufacturing.

Figure 4:
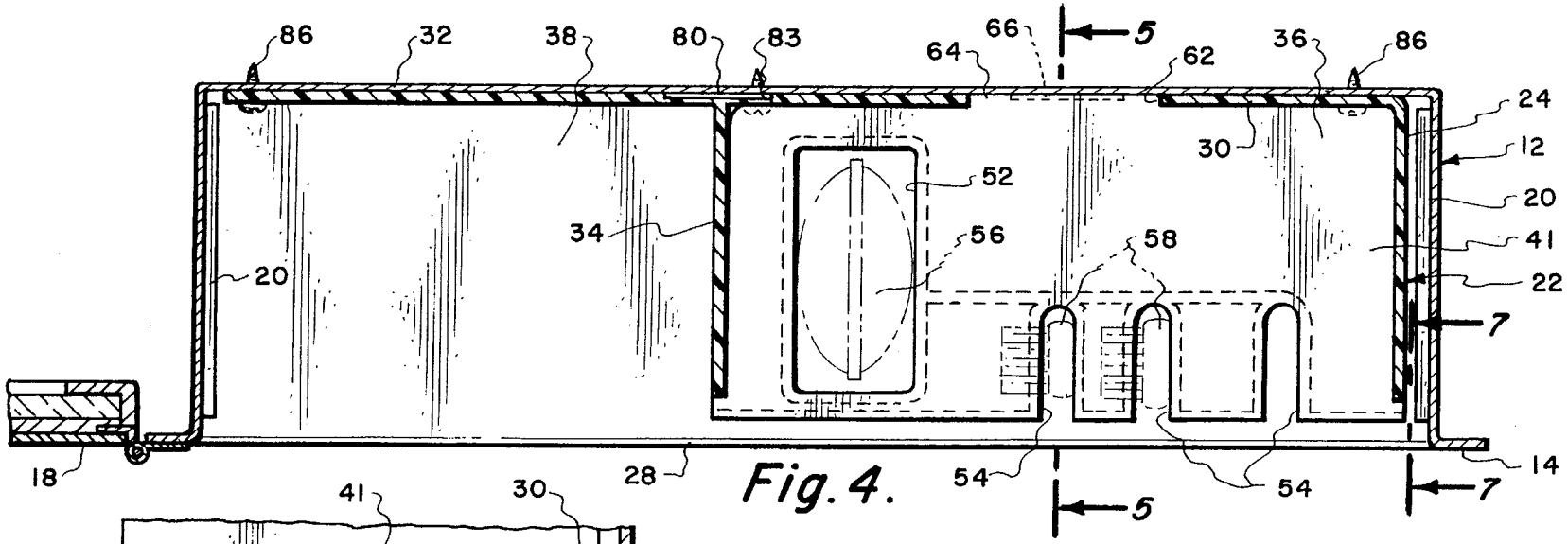
FIG. 4 is a sectional view taken at 4—4 of FIG. 1.

An optional but preferred alternative is to secure medicine cabinet organizer 10 in medicine cabinet 12 with screws 86 providing a more fixed installation. Screws 86 would preferably be sheet metal screws that would penetrate back wall 32 of medicine cabinet 12 as shown in FIG. 4. However double surface adhesive tape 80 might be preferable if reuse of the medicine cabinet organizing insert 10 were desired.

The details of adjustable shelves 40, 41 and 42 are illustrated in FIGS. 4–8. Adjustable shelf 41 is provided with a rectangular slot 52 and open slots 54 for holding toothpaste 56 and toothbrushes 58 (FIG. 1) razors and the like. Adjustable shelf 42 positioned below shelf 41 provides a cup shaped slot 60 for receiving the dispensing end of toothpaste 56 or any similar shaped article. Slots 54 receive the bristles and brush head of a toothbrush 58 while slots 55 are provided in adjustable shelf 42 receive the handle.

Figure 7:
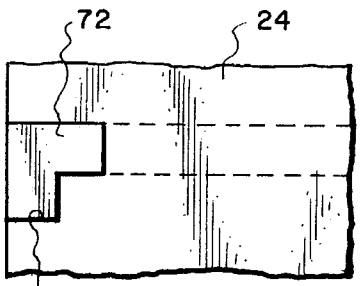
FIG. 7 is a partial sectional view taken at 7—7 of FIG. 4.
Figure 6:
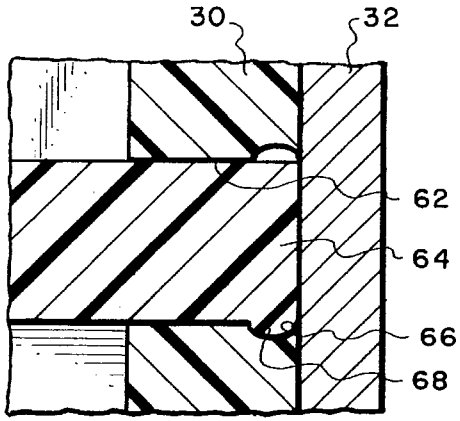
FIG. 6 is an enlarged partial section taken at 6 of FIG. 5.
Figure 5:
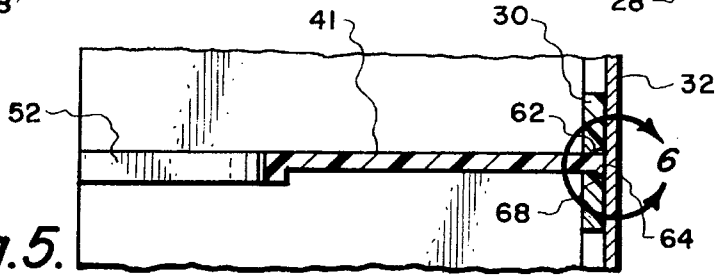
FIG. 5 is a sectional view taken at 5—5 of FIG. 4.
Figure 8:
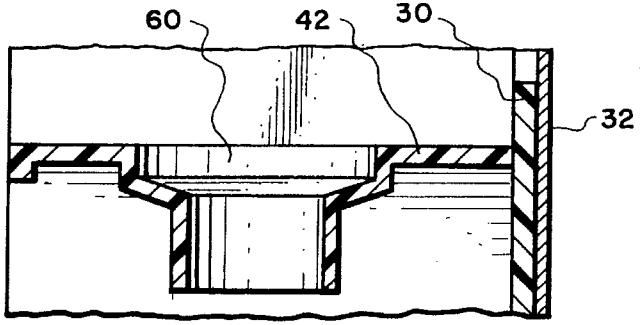
FIG. 8 is a partial section taken at 8—8 of FIG. 1.

All the adjustable shelves 40, 41 and 42 are supported in rectangular frame 22 of medicine cabinet organizer 10 as illustrated in FIGS. 5–7. Back 30 of rectangular frame 22 has a plurality of horizontal slots 62 for providing support for the respective adjustable shelves. Each adjustable shelf 40, 41 and 42 has a tongue 64 having a width that fits horizontal slots 62. Slots 62 have a lengthwise groove 66 for receiving a ridge 68 beneath tongue 64 of each adjustable shelf to frictional hold or lock each adjustable shelf in a selected position. The rear of each adjustable shelf is supported by an L-shaped notch 70 along the vertical edge of side wall 24 and vertical divider 34.

The installation of the adjustable shelves is shown in greater detail in FIGS. 4–8. As illustrated in FIG. 4, specially designed shelf 41 has cutouts 52 and 54 for receiving toothpaste 56 and toothbrushes 58, razors and the like. Adjustable shelf 42 has a cup shaped slot 60 for receiving the dispensing end of toothpaste 56.

Adjustable shelves 40, 41 and 42 are secured in frame 22 by tongue 64 that frictionally fits slots 62 in back wall 30 of frame 22. Each tongue 64 on an adjustable shelf has a ridge 68 fitting a groove 66 in slot 62. An L-shaped notch 70 (FIG. 7) in side wall 24 and vertical divider 34 are provided to receive L-shaped tabs on the respective ends of each adjustable shelf. Ridge 68 on the underside of tongue 64 of each shelf, frictionally secures and locks each shelf in slot 62 but allows it to be easily removed to change the configuration of medicine cabinet organizer 10.

To remove or install an adjustable shelf, the shelf is pulled away from the cabinet allowing tongue 64 and tab 72 to detach from slot 62 and notches 70. The shelf can then be reinstalled at a higher or lower location by inserting tongue 64 in a slot 62 and pushing it forward until ridge 68 snaps into groove 66 in slot 62. Thus each adjustable shelf is securely installed and supported both in the forward edge and rear edge by slot 62 and notches 70.

Figure 9:
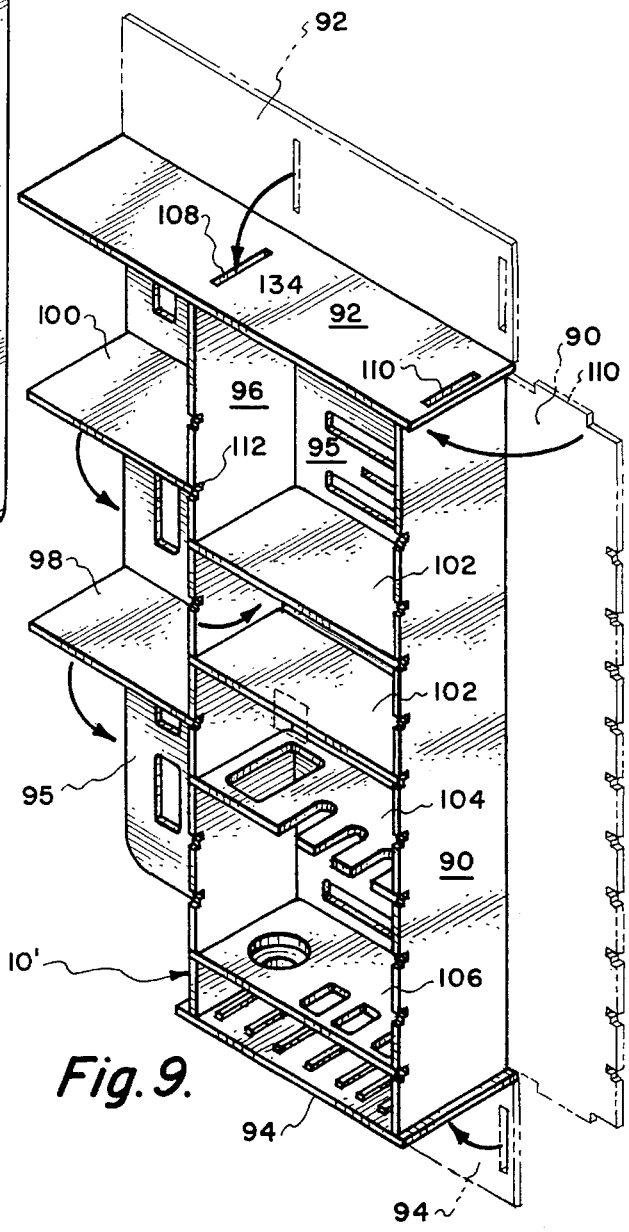
FIG. 9 is a perspective view of a medicine cabinet organizer that can be constructed to lie flat for shipping purposes.

An optional embodiment is shown in FIG. 9 that is constructed for ease of shipping of the medicine cabinet organizer. In this embodiment medicine cabinet organizer 10' has hinged side wall 90, hinged top wall 92 and hinged bottom wall 94. Each of these hinged walls allow the rectangular frame to lie flat for shipping purposes. Each of side wall 90, top wall 92, and bottom wall 94 are attached to back wall 95 by a self hinged form of the same material the frame is formed of. The center divider 96 and fixed shelves 98 and 100 are also attached to back wall 95 by self hinges allowing them to be folded nearly flat against back wall 95. For storage and shipping purposes, adjustable shelves 102, 104 and 106 will be removed. Side wall 90, top wall 92, bottom wall 94, center divider 96 and shelves 98 and 100 are then folded flat allowing medicine cabinet organizer 10 to be shipped as a flat package at considerably lower cost.

To assemble the medicine cabinet organizer, side wall 90, top wall 92 and bottom wall 94 would be folded as shown engaging tongues 108 in center divider 96 and 110 in side wall 90 to secure top and bottom walls 92 and 94. Adjustable shelves 102, 104 and 106 would then be installed as before with tongues (not shown) engaging slots in back wall 95. Fixed shelves 98 and 100 would be rotated into a horizontal position engaging notches 112 in center divider 96.

Adjustable shelves 102, 104 and 106 would be constructed as described with the fixed rectangular frame of the embodiment shown in FIGS. 1–3. Adjustable shelf 104 would have the slots for receiving toothpaste and toothbrushes with adjustable shelf 106 having corresponding slots.

Thus there has been disclosed a novel medicine cabinet organizing insert that allows a user to maximize storage space in existing medicine cabinets. The medicine cabinet is comprised of a polystyrene plastic frame separated by a divider into 60% and 40% vertical compartments. The 60% vertical compartment has adjustable shelves for maximizing storage space. Two of the shelves are provided with novel designs for storing toothpaste, toothbrushes, razors and the like. Additionally, one side of the rectangular frame forming the medicine cabinet organizer is open and has scored areas to change the relative width for narrower existing medicine cabinets. The height of medicine cabinet organizer is designed to allow the top wall to be used as the top shelf when installed in a medicine cabinet, Installation can be easily performed with double surface adhesive tape squares applied to flat areas, indentations or recesses on the rear of the frame or optionally in a fixed installation with mounting screws.

This invention is not to be limited by the embodiment shown in the drawings and described in the description which is given by way of example and not of limitation, but only in accordance with the scope of the appended claims.

What is claimed is:

1. A medicine cabinet organizing device comprising;

organizer insert means for inserting inside a housing of an existing medicine cabinet, said organizer insert means being comprised of a substantially rectangular frame having at least one side wall, a back wall, bottom wall and a top wall, the height of said organizer insert means providing a top shelf when installed in an existing medicine cabinet housing;

fastening means for fastening said organizer insert means to a rear wall of said existing medicine cabinet;

dividing means vertically dividing said organizer insert means into two vertical compartments, one of said compartments having a plurality of adjustable shelves; the other vertical compartment having at least one fixed shelf;

whereby said organizing device can be installed in said existing medicine cabinet and provide a plurality of adjustable spaces between said adjustable shelves for storing toilet articles.

2. The device according to claim 1 in which said at least one side wall, vertical dividing means, said bottom wall and said top wall, are hinged to fold flat for shipping said organizing device.

3. The device according to claim 1 in which said rear wall of said organizer insert means rectangular frame is formed integrally with a side wall and said dividing means.

4. The device according to claim 1 in which said fastening means comprises a plurality of adhesive means on the rear of said rear wall for securing said organizer insert means to the back wall of said existing medicine cabinet.

5. The device according to claim 1 in which said fastening means comprises a double face adhesive material covered with a release paper for affixing to the back of said organizer insert means at selected areas and for securing to the back wall of said existing medicine cabinet after removal of said release paper.

6. The device according to claim 1 in which one side of said organizer insert means is open; said open side having a plurality of scored surfaces to permit removal of a portion of said open side to accommodate different width medicine cabinets.

7. The device according to claim 1 in which said vertical dividing means is fixed to divide said organizer insert means into two vertical compartments.

8. The device according to claim 7 in which said vertical compartment having at least one fixed shelf has three fixed shelves.

9. The device according to claim 1 in which a lower corner of said organizer insert means is constructed to be open to fit a variety of widths and shapes of medicine cabinets.

10. The device according to claim 9 in which said lower corner, back edges and sides are are curved to accommodate a curved radius at the bottom side of said existing medicine cabinet frame.

11. The device according to claim 1 in which said fastening means comprises a plurality of mounting screw holes in said rear wall of said organizer insert means for mounting said organizer insert means insert with screws.

12. The device according to claim 11 in which said at least one fixed shelf has a scored surface for removal of a portion of the shelf to accommodate different width medicine cabinets.

13. The device according to claim 1 in which said vertical divider means is fixed to divide said organizer insert means into vertical compartments that are 60% and 40% of the width of said organizer insert means respectively.

14. The device according to claim 13 in which said compartment having adjustable shelves is said 60% width vertical compartment.

15. The device according to claim 13 in which said vertical compartment having said at least one fixed shelf is said 40% vertical compartment.

16. The device according to claim 13 in which said adjustable shelf compartment has a bottom shelf, said bottom shelf has a ribbed surface to prevent small stored articles from rolling out.

17. The device according to claim 1 including shelf support means in said back and said at least one side wall of said organizer insert means.

18. The device according to claim 17 in which said shelf support means comprises a plurality of spaced apart slots in said back wall of said insert; and a plurality of notches in a forward edge of the frame of said insert.

19. The device according to claim 18 in which said notches are L-shaped slots for properly orienting said adjustable shelves.

20. The device according to claim 19 in which said adjustable shelves have a tongue on a back edge constructed to fit a selected slot; and a pair of tabs to fit said notches;

said tabs having a keyed portion for fitting said L-shaped notches to orient said shelves.

21. The device according to claim 20 in which each of said slots has a groove; said tongue on said adjustable shelves having a ridge constructed to engage said groove to frictionally retain said tongue in said slot.

22. The device according to claim 20 in which at least one of said adjustable shelves has holes constructed to specifically store toothpaste, toothbrushes, razors.

23. An organizing device for replacing shelves in existing medicine cabinets comprising;

organizing insert means for fitting the interior of an existing medicine cabinet after all of said existing cabinets shelves have been removed;

said organizing insert means having at least one side wall, an upper wall and a lower wall and divider means dividing said organizing insert means into two separate compartments, the height of said organizer insert means being less than the interior height of said existing medicine cabinet so that said upper wall may be used as a shelf;

at least one of said compartments having a plurality of adjustable shelves, said adjustable shelves fitting mounting slots in said at least one side wall and said divider means;

mounting means for mounting said organizing insert means in said existing medicine cabinet, said mounting means comprising means for securing said organizing insert means to a surface on the housing of said existing medicine cabinet;

whereby said shelves in said existing medicine cabinet may be removed and replaced with said organizing insert means to improve the storage capability of said existing medicine cabinet.

24. The organizing device according to claim 23 in which said organizing insert means has a back wall; said mounting means comprising an adhesive means on said back wall covered with a release paper for fastening said organizing insert means to a rear wall of an existing medicine cabinet.

25. The organizing device according to claim 23 in which said organizing insert includes fitting means for fitting said medicine cabinet to a variety of existing spaces in existing medicine cabinets.

26. The organizing device according to claim 23 in which said organizing insert includes fitting means for fitting said medicine cabinet to a variety of existing spaces in existing medicine cabinets.

27. The organizing device according to claim 26 in which said fitting means comprises; an open side on said organizing insert means; said organizing means being scored along said open side; whereby a portion of said open side may be removed by breaking at said scoring so that said organizing medicine cabinet insert means will fit the interior of a variety of existing medicine cabinets.

28. The organizing device according to claim 27, said fitting means comprising; an open side on said organizing insert means; said organizing means being scored along said open side; whereby a portion of said open side may be easily removed by breaking at said scoring so that said organizing medicine cabinet insert means will fit the interior of a variety of existing medicine cabinets.

29. The organizing device according to claim 23 wherein said divider means is a fixed partition to divide said organizing insert into vertical compartments of 60% and 40% of the width of said organizing insert means respectively.

30. The organizing device according to claim 29 in which said compartment having said adjustable shelves in said 60% vertical compartment.

31. The organizing device according to claim 30 in which the other of said compartments has at least one fixed shelf.

32. The organizing device according to claim 27 in which the height of said organizing insert means provides a top shelf on said upper wall.

* * * * *